US007501178B2

(12) United States Patent
Sato

(10) Patent No.: US 7,501,178 B2
(45) Date of Patent: Mar. 10, 2009

(54) FIBER FOR ARTIFICIAL HAIR

(75) Inventor: Issei Sato, Minato-ku (JP)

(73) Assignee: Mitsui Chemicals Inc, Tokyo (JP)

( * ) Notice: Subject to any disclaimer, the term of this patent is extended or adjusted under 35 U.S.C. 154(b) by 275 days.

(21) Appl. No.: 10/558,587

(22) PCT Filed: May 17, 2004

(86) PCT No.: PCT/JP2004/006989

§ 371 (c)(1),
(2), (4) Date: Nov. 29, 2005

(87) PCT Pub. No.: WO2004/106600

PCT Pub. Date: Dec. 9, 2004

(65) Prior Publication Data

US 2006/0275603 A1 Dec. 7, 2006

(30) Foreign Application Priority Data

May 30, 2003 (JP) ..... 2003-154965

(51) Int. Cl.
*D02G 3/00* (2006.01)

(52) U.S. Cl. ..... 428/364; 428/394; 428/395; 428/399

(58) Field of Classification Search ..... 428/364, 428/394, 395, 399
See application file for complete search history.

(56) References Cited

U.S. PATENT DOCUMENTS 5,895,718 A 4/1999 Ishimura et al.
6,156,842 A * 12/2000 Hoenig et al. ..... 525/171
6,159,598 A 12/2000 Ishimura

FOREIGN PATENT DOCUMENTS

EP 1632594 * 8/2007
JP 47-009851 B 3/1972
JP 59-112023 A 6/1984

(Continued)

OTHER PUBLICATIONS

Taiwanese Patent Application No. 093114252, Office Action corresponding to Application No. 10558587 filed on Nov. 29, 2005.

(Continued)

*Primary Examiner*—N. Edwards
(74) *Attorney, Agent, or Firm*—Amin, Turocy & Calvin, LLP

(57) ABSTRACT

The object of the present invention is to provide fiber for artificial hair which is deformable by hands at will and has the shape-retaining property. The present invention relates to fiber for artificial hair containing a plastically deformable filament (A) containing a thermoplastic resin having the restoration angle of not more than 30 degrees, after 10 minutes from bending it at 90 degrees. Further, it relates to fiber for artificial hair, which has the shape retention of not less than 30% when it is wound ten times on a cylindrical collar having a diameter of 10 mm and allowed to stand for 10 minutes, and the cylindrical collar was removed and allowed to stand for 5 minutes. The invention also relates to fiber for artificial hair, which is utilized for periwigs, wigs, doll hair, hair accessories, eyelashes, beards or the like by further coloring them.

11 Claims, 1 Drawing Sheet

FOREIGN PATENT DOCUMENTS

| | | | | |
|---|---|---|---|---|
| JP | 62-041311 | A | | 2/1987 |
| JP | 03-241012 | | | 10/1991 |
| JP | 07-238417 | | | 9/1995 |
| JP | 8-144123 | A | | 6/1996 |
| JP | 410053917 | A | * | 2/1998 |
| JP | 10-118341 | A | | 5/1998 |
| JP | 10-266035 | | | 6/1998 |
| JP | 2000-178833 | | | 6/2000 |

OTHER PUBLICATIONS

International Search Report, PCT/JP2004/006989, Aug. 31, 2004.

* cited by examiner

FIBER FOR ARTIFICIAL HAIR

TECHNICAL FIELD

The present invention relates to fiber for artificial hair useful for periwigs, wigs, doll hair, hair accessories, eyelashes, beards and the like, having light-weightness and being deformable at will.

BACKGROUND ART

Since ancient times, human hair has been processed into periwigs, wigs or the like, but human hair is expensive and has restriction of the amount of use (amount of production) or length thereof, so that various artificial hairs have been employed as an alternative. Since human hair is straight, curly or waved in nature depending on the individuals, it has been required that artificial hair should be capable of transformation into various shapes with ease as conforming to the texture of human hair, but should not be transformed during the use.

As examples of deformable artificial hair, suggested are fiber for doll hair comprising a thermoplastic resin and filaments composed of a thermoplastic polymer having a glass transition temperature of from 0 to 70° C. (claim 1 of JP1998-118341A) and shape-memorial mono-filaments composed of filaments which comprise a polyurethane composition having a glass transition temperature of from −30 to 70° C. (claim 1 and column 6 of page 4 of JP1996-144123A). When those filaments are used as doll hair, however, the hair cannot be transformed at will if not a certain temperature, and even after the transformation, the hair may be recovered to the shape before the transformation with some condition of temperature change or the like.

The object of the present invention is to provide fiber for artificial hair which is freely deformable by hands at room temperature and has the shape-retaining property.

DISCLOSURE OF THE INVENTION

That is, the present invention relates to fiber for artificial hair containing a plastically deformable filament (A) containing a thermoplastic resin having the restoration angle of not more than 30 degrees after 10 minutes from bending it at 90 degrees. Furthermore, the invention relates to fiber for artificial hair, which has the shape retention of not less than 30% when it is wound ten times around a cylindrical collar having a diameter of 10 mm and allowed to stand for 10 minutes, and it is removed from the cylindrical collar and allowed to stand for 5 minutes. Further, the invention also relates to fiber for artificial hair which is used for periwigs, wigs, doll hair, hair accessories, eyelashes, beards, or the like by coloring them.

BEST MODE FOR CARRYING OUT THE INVENTION

Plastically Deformable Filament (A) Containing a Thermoplastic Resin

The raw material for the plastically deformable filament (A) containing a thermoplastic resin according to the present invention is a thermoplastic resin such as polyolefins (such as polyethylene, polypropylene, poly 4-methyl-1-pentene, polybutene and the like), polyesters (such as polyethylene terephthalate, polybutylene terephthalate, polyethylene naphthalate, poly lactate and the like), and polyamides (such as Nylon-6, Nylon-66, poly-m-xylene adipamide and the like). Among these thermoplastic resins, preferable is polyolefin, for example, a homopolymer of α-olefin such as ethylene, propylene, butylene-1, heptene-1, hexene-1, octene-1, 4-methyl-pentene-1 and the like, or a copolymer thereof with other α-olefins; more specifically, preferable are ethylene based polymers such as high pressure, low density polyethylene (HP-LDPE), straight-chain or linear low density polyethylene (LLDPE), medium density polyethylene (MDPE) and high density polyethylene (HDPE), propylene based polymers such as a propylene homopolymer and a propylene-α-olefin random copolymer and the like, and polymers such as poly 4-methyl-1-pentene, polybutene and the like.

Furthermore, among the polymers, the ethylene based polymers or the propylene based polymers are desirable from the fact that a filament having excellent elongation and good shape-retaining property is obtained. In particular, the medium density polyethylene and the high density polyethylene are preferable because of their light-weightness and excellent weather resistance. The medium density polyethylene usually has a density in the range of not less than 0.930 and less than 0.945 g/cm$^3$, while the high density polyethylene usually has a density of not less than 0.945 g/cm$^3$, and preferably in the range of 0.955 to 0.970 g/cm$^3$. Further, the high density polyethylene preferably has the molecular weight distribution (weight average molecular weight (Mw)/(Mn)) of from 2 to 15 and preferably from 5 to 15 according to the gel permeation chromatography (GPC), and the amount of α-olefin having 3 to 6 carbon atoms of less than 2% and preferably from 0.05 to 1.5 weight % because a filament having light-weightness and excellent rigidity, strength, weather resistance or the like is obtained.

Figure 1:
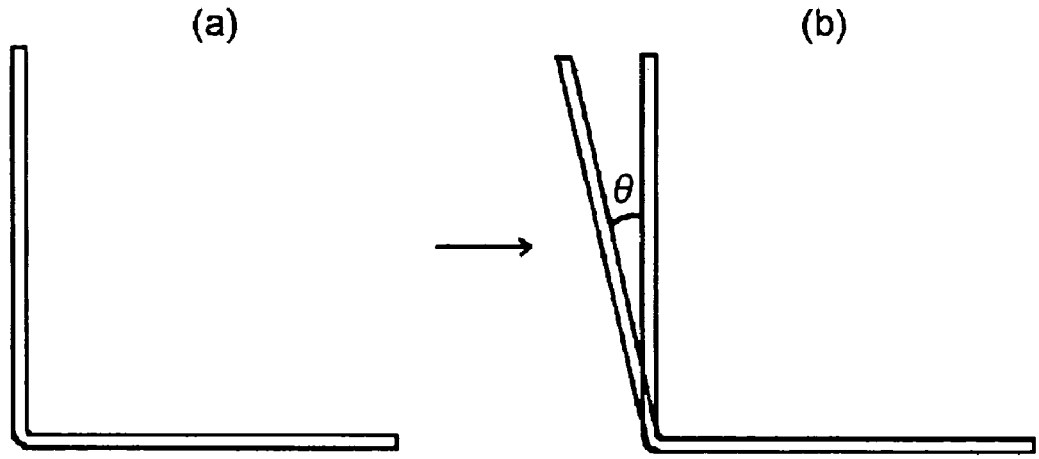
FIG. 1 illustrates the restoration angle after 10 minutes from bending at 90 degrees.
Figure 2:
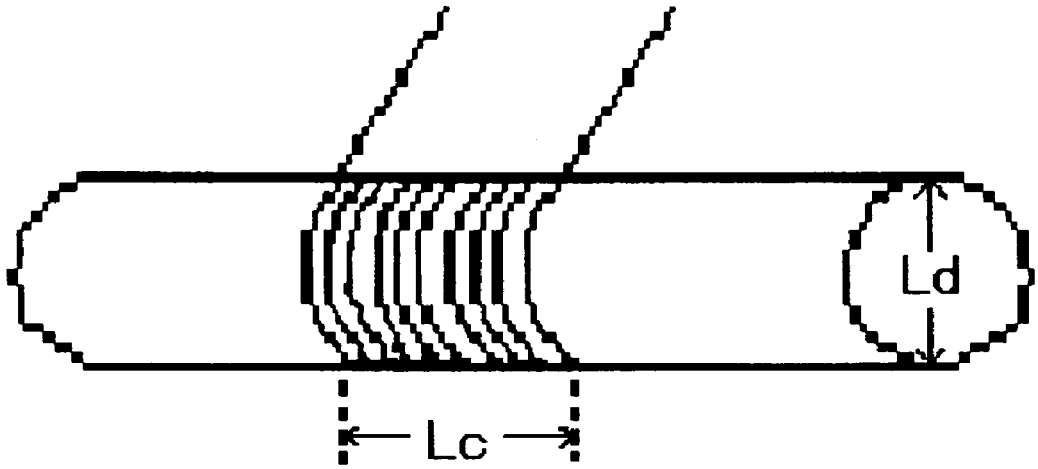
FIG. 2 shows a filament wound ten times around a cylindrical collar having a diameter of 10 mm, wherein Ld refers to a diameter of the collar and Lc refers to a winding width of the filament.

The plastically deformable filament (A) containing a thermoplastic resin according to the present invention has the restoration angle of not more than 30 degrees, preferably not more than 20 degrees, and more preferably not more than 10 degrees, after 10 minutes from bending it at 90 degrees. If the restoration angle after bending it at 90 degrees is more than 30 degrees, the filament may not retain the shape-retaining property. The restoration angle after bending it at 90 degrees refers to the angle θ as shown in FIG. 1(*b*) after the filament is bent at 90 degrees as shown in FIG. 1(*a*) and allowed to stand for 10 minutes. Further, the measurement was carried out under the identical conditions at a temperature of 23° C. and a relative humidity of 50% after being allowed to stand for 24 hours. If the flexural strength (ATMS D790) of the filament (A) containing a thermoplastic resin is preferably not less than 400 kg/cm2, and more preferably not less than 470 kg/cm2, the shape-retaining property of the filament is excellent.

Meanwhile, the plastically deformable filament (A) containing a thermoplastic resin according to the present invention has the shape retention of not less than 30% when it is wound ten times around a cylindrical collar having a diameter of 10 mm and allowed to stand for 10 minutes, and it is removed from the cylindrical collar and allowed to stand for 5 minutes. The shape retention is preferably not less than 40%, more preferably not less than 50%, and particularly preferably not less than 60%. The shape retention is measured as follows. A filament is cut at a length of 350 mm, and wound around a cylindrical collar having a diameter of 10 mm (Ld) ten times at room temperature (23° C.). The winding of the filament around the collar should be done with the winding width (Lc) of not more than 10 mm, while the filament should not be intersected each other. The filament is wound around the collar with both ends open, and allowed to stand at room temperature for 10 minutes. Then, the filament is removed from the cylindrical collar, the filament is allowed to stand for 5 minutes, and the number of windings maintained at that time is counted. In the same method, 5 samples are measured, and mean percentage (%) of the number of windings maintained out of the 10 windings is calculated: the percentage value is referred to as the shape retention.

What is important for the present invention is to use the filament containing a thermoplastic resin having the shape-retaining property as described above as fiber for artificial hair.

The cross-section of the plastically deformable filament (A) containing a thermoplastic resin according to the present invention may be any shape including oval, polygons such as triangle, tetragon, pentagon and hexagon, star or gear type, as well as a circle. In addition, one or more groove(s) or stripe(s) may be created along the longitudinal direction.

The fiber diameter of the plastically deformable filament (A) containing a thermoplastic resin according to the present invention can be suitably selected depending on its use, but it is usually from 30 to 500 μm, preferably from 60 to 270 μm, and more preferably from 60 to 120 μm. In case of using the filament for supplementation of human hair such as periwigs, wigs or the like, it is not unnatural if it is from 70 to 100 μm as that of human hair, but somewhat different fiber diameter is also acceptable because of the differences between individuals.

Colorant

The colorants according to the present invention may be those originated from nature such as minerals, animals or plants, or artificially produced one, including both inorganic and organic substances. Depending on the applications, various pigments or dyes to be described below can be employed, though not restricted thereto. Examples of the inorganic colorant include cadmium red, Bengala, yellow chrome, zinc chromate, ultramarine blue, cobalt blue, cobalt violet, chrome titan white, white lead, carbon black, and the like. Further, examples of the organic colorant include nitroso dyes, nitro dyes, azo dyes, stilbene dyes, diphenylmethane dyes, triarylmethane dyes, Janssen dyes, acridine dyes, quinoline dyes, (poly)methine dyes, thiazole dyes, indamane dyes, azine dyes, oxazine dyes, thiazine dyes, sulfide dyes, aminoketone dyes, oxyketone dyes, anthraquinone dyes, indigoid dyes, phthalocyanine dyes, and the like. In addition to common coloring pigments or coloring dyes, pigments or dyes showing fluorescence or change in color depending on the temperature may be employed. These colorants may be employed as a complex color or tone by mixing a plurality of colorants as needed.

The amount of colorants to be mixed can be suitably selected, but it is usually preferably from 0.01 to 10 weight %, and more preferably from 0.01 to 5 weight %. When the colorant is mixed in an excessive amount, the deformability or shape-retaining property of the filament containing a thermoplastic resin may be impaired, or the filament cannot be sufficiently elongated to provide the shape-retaining property because it may be broken during the elongation.

Process for Preparing a Plastically Deformable Filament (A) Containing a Thermoplastic Resin The plastically deformable filament (A) containing a thermoplastic resin according to the present invention can be prepared from the thermoplastic resin in various processes. For example, it can be prepared by melt molding a thermoplastic resin to obtain grey yarn of a desired shape, cooling the yarn, and elongating the yarn by heating it at a temperature below the melting point. When the raw material is high density polyethylene, the grey yarn is melt extruded at a temperature of from 250 to 300° C., and spun from the nozzles at the front of an extruder. The nozzle preferably has a diameter of from 0.1 to 2 mm. Cooling is conventionally carried out in a water tank, of which the temperature is preferably from 40 to 60° C. from the aspect of operative stability. If the temperature of the water tank is below 40° C., the spun filament skews in the water tank so that the filaments may be bonded to each other. If the temperature is higher than 60° C., the spun filament becomes soft and is apt to be stretched. As the grey yarn, employed may be what is divided from film to make thread form.

In order to obtain the filament containing a thermoplastic resin having the shape-retaining property according to the present invention, it is important to select the elongation temperature and elongation ratio of the grey yarn, whereas suitable conditions can be sought depending on the thermoplastic resin in use. The elongation temperature is properly selected depending on the thermoplastic resin in use, in order to elongate the resin to the extent that the shape-retaining property can be exhibited, and the temperature is lower than the melting point of the thermoplastic resin. For example, if the raw material is high density polyethylene, the temperature is 100(C and preferably from 85(C to 100(C. Elongation may be carried out in hot air, hot water, or hot medium, but preferably in hot water from the material having a high heat capacity. The elongation ratio is somewhat different depending on physical properties of grey yarn or elongation temperature, but it is selected in the range to exhibit the deformability, conventionally in the range of not less than the yield point and not more than the rupture point, that is, from 2 to 30 folds, and preferably from 7 to 15 folds. If the elongation ratio is insufficient, the plastically deformable filament (A) containing a thermoplastic resin having the restoration angle of not more than 30 degrees after 10 minutes from bending it at 90 degrees cannot be obtained.

Process for Coloring a Plastically Deformable Filament (A) Containing a Thermoplastic Resin The filament containing a thermoplastic resin according to the present invention can be colored by applying a desired colorant to the plastically deformable filament (A) containing a thermoplastic resin. Specifically, the processes include direct coloring on the plastically deformable filament (A) containing a thermoplastic resin itself or applying a colorant on the surface of the filament (A) containing a thermoplastic resin, though not restricted thereto, as far as the filament (A) containing a thermoplastic resin can be colored.

The plastically deformable filament (A) containing a thermoplastic resin according to the present invention is, when the filament (A) containing a thermoplastic resin itself is colored, conventionally prepared by mixing the raw material with a colorant to prepare grey yarn, and then elongating it.

If the colorant is applied to the surface of the plastically deformable filament (A) containing a thermoplastic resin, a colorant in a liquid phase is applied or sprayed on the surface, or the filament is impregnated with a colorant, to form a coated film with color on the surface. The colorants, which are previously mixed to prepare the solution of colorants with desired color and tone, may be applied, or some kind of colorant solution may be applied and the other colorant solution may be additionally applied over the first colorant. A part of the filament (A) containing a thermoplastic resin may be colored, or the color may be gradually changed with color gradation. By using these techniques, natural texture can be expressed with complex color and tone. In order to prevent the colorant from being peeled off, a colorant thickening agent may be previously applied to the surface of the filament (A) containing a thermoplastic resin and then a desired colorant may be applied thereto, or the colorant mixed with a colorant thickening agent may be applied. Alternatively, in order to stabilize the fixation of colorant on the surface of the filament (A) containing a thermoplastic resin, a fixing agent may be covered after the application of the colorant, or a treatment for making the colorant penetrate into the surface portion of the filament (A) containing a thermoplastic resin may be carried out. In order to carry out the penetration of the colorant with high efficiency, it is desirable to properly warm the surface of the filament (A) containing a thermoplastic resin, or to provide unevenness to increase the surface area of the filament (A) containing a thermoplastic resin.

Various colors of the plastically deformable filament (A) containing a thermoplastic resin can be selected depending on the application of the fiber for artificial hair, for example, it can be red, orange, yellow, blue, violet, white, gold or silver with appropriate tone. By using multiple coloring, the filament (A) containing a thermoplastic resin may have longitudinal or transverse stripes or features of gradation. In addition, by scattering some colored substances, transparent or translucent particulate substances or reflective substances such as metal fragments, it is possible to give spots or luster.

In case of use for wigs to compensate lack of hair on a human head, it is usually desirable to provide black, liver brown, nutbrown, gray, blond, silver or white color in order to give natural texture, while in case of use for dandyism, it may also be colored as desired.

To the thermoplastic resin, which is a raw material for the plastically deformable filament (A) containing a thermoplastic resin according to the present invention, various additives may be added to provide mold processability, anti-static property, water resistance, water repellence, hydrophilicity, weather resistance, antibacterial property or the like, to the extent that the object of the present invention is not impaired. In case of employing those additives, it is preferable to add them in consideration of the resultant color or tone after mixing, in order not to impair the intended color or tone. Examples of those additives include processing aids, anti-static agents, inorganic fillers or the like. More concrete examples of the processing aids include low molecular weight polyolefins, alicyclic polyolefins, synthetic oils containing a carboxylic group or a hydroxyl group, mineral oils, waxes containing vegetable oils such as carnauba wax, anti-static agents containing various types of surfactants, or polymeric anti-static agents such as polyoxyolefin type resins, ionomer resins or the like. If being wax or anti-static agent, it is mixed in a proportion of not more than 5 weight %, and preferably not more than 1 weight %. Addition of waxes may be effective on increasing the dimensional accuracy during melt molding or elongation of grey yarn, while addition of inorganic fillers on improving the shape-retaining property in some cases.

Fiber for Artificial Hair

The fiber for artificial hair according to the present invention contains the plastically deformable filament (A) containing a thermoplastic resin having the restoration angle of not more than 30 degrees after 10 minutes from bending it at 90 degrees.

The fiber for artificial hair according to the present invention can be processed for use as an alternative of human hair or applied to toys such as dolls and the like. Specifically, it can be used for periwigs, wigs, doll hair or hair accessories.

Wig means ornaments essentially for dandyism, which is attached on the surface of head both for men and women. Depending on the application areas, wigs are classified into partial wigs, half wigs, 7/10 wigs, full wigs, or the like. On the other hand, hair accessories collectively refer to ornaments attached to original hair or scalp, other than wigs. Examples thereof include extensions which are attached by means of hair pins or hair clips to make the original hair seem to be longer, weavings (simply tied fibers, or fiber bundles processed in a shape of traditional waist raincoat made of straw, which is called to as weft by a person having ordinary skills in the art, or ornaments prepared by curling those products) which are sealed to original hair by weaving along the scalp or essentially attached on original hair or scalp as band type by means of adhesives or the like. In addition, they include forming the shape of up-style hair by winding, hanging or twining around the hair, or tying or gathering the hair. Doll hair means what is applied to head, eyes, body part, hands or feet of a product having human shape, and it can be used, for example, as hairs of Japanese dolls which are shaped into Japanese style hair, hair of a mannequin, or hair-style samples in hair salons. In addition, doll hair includes certain products having the shape of an animal or a plant, and examples thereof include whiskers, tails or body hair of animals, bines of plants, and the like.

When these hair ornaments are processed by using the fiber for hair according to the present invention, various processes can be employed. For example, in case of preparing a wig, a bundle of fibers are sewed by using a wig sewing machine to make a shape of a traditional straw raincoat, which is then sewed on a hair cap. For a certain style, for example, it is sufficient to wind the fiber around a pipe in order to provide curls, and to insert in a wave-shaped plate in order to provide waves. If it is desired to straighten the fiber, it may be pulled and stretched by hands.

When the fibers are used for doll hairs, the process may contain a method of planting hairs on a product having human, animal or plant shape; planting hairs by the use of a hair-planting machine; holding the end portion of hairs by using a holding piece that can tie multiple hairs together and fixing the holding piece onto the portion of a doll to be planted; inserting hairs between metallic threads, sealing the metallic threads to hold the hairs in it, and fixing the metallic threads onto the portion of a doll to be planted; or integrally molding the hair with head part or scalp of a doll.

EFFECT OF THE INVENTION

The fiber for artificial hair according to the present invention may be colored with a colorant such as pigments or dyes as desired, whereby it can be employed without unnaturalness as an aid or an alternative of human hair, or used for dandyism. The fiber can be repeatedly used by setting the shape in order by hands or by transforming it into other shapes, so that it can be handled with ease and the shape can be maintained as it is. Accordingly, the fiber can be employed for periwigs, wigs, doll hair, hair accessories, eyelashes, beards, or the like by virtue of its characteristic properties.

EXAMPLES

Example 1

Preparation of a Plastically Deformable Filament Containing a Thermoplastic Resin To 100 weight parts of high density polyethylene containing 1.2 weight % of propylene as a comonomer (the content of the comonomer was measured by means of NMR; MFR measured according to ASTM D1238 was 0.35 g/10 min, Mw/Mn calculated from the weight average molecular weight (Mw) and the number average molecular weight (Mn) measured by the gel permeation chromatography (GPC) was 12; a density measured according to ASTM D1505 was 0.958 g/cm$^3$, and a melting point was 135° C.), added was a master batch for coloring in a proportion of 3 weight parts, to obtain a mixture. The master batch had been obtained by kneading 5 weight parts of anthraquinone type yellow and 10 weight parts of disazo type yellow with 100 weight parts of medium density polyethylene (manufactured by Mitsui Chemicals, Inc., density: 0.943 g/cm$^3$), and pelletizing the mixture by using an extrusion molder. The mixture containing the master batch was melt spun under the following conditions, elongated with the elongation ratio of 15 folds in the longitudinal direction, and annealed.

Extruder: 30 mmϕ (L/D=28, compression ratio 2.3)

Die opening: 30 mm×3.6 mm

Molding temperature (cylinder and die): 290° C.

Cooling tank: 1400 mm

Drawing speed during melt spinning: 4 m/min

Elongation tank: 95° C. water tank (length 1700 mm)

Annealing tank: 140° C. electric heat oven, length 2000 mm

Winding speed during the elongation: 52 m/min

While measuring the diameter of the resultant filament (maximum thickness) by the use of a slide calipers, the restoration angle θ after allowing it to stand for 10 minutes after bending at 90 degrees was measured, as shown in FIG. 1. The fiber diameter was 70 (m, and the restoration angle after ten minutes from bending it at 90 degrees was 5 degrees.

The thus-obtained filaments colored yellow were cut at a length of 30 cm in order to use them for artificial hair of a western-style doll. A plurality of filaments were tied, and the tied portion was fixed on the crown of head of the doll to make its hair. The 20 cm portion at the end of the hair was slightly wound up on an article having a roll shape to make a waved shape as desired. The feature of waved hair could maintain its shape as it was, and the hair style was not impaired when the doll was stood decoratively. Afterwards, when the hair was frizzled in order to obtain more delicate wave, the hair was easily transformed by hands and maintained the shape as it was.

Example 2

A filament was obtained in the same manner as in Example 1, except that a mixture of phthalocyanine blue with medium density polyethylene (manufactured by Mitsui Chemicals, Inc., density 0.943 g/cm3) was used as a master batch, instead of the mixture used in Example 1. While measuring the diameter of the resultant filament (maximum thickness) by the use of a slide calipers, the restoration angle (after allowing it to stand for 10 minutes after bending at 90 degrees was measured, as shown in FIG. 1. The fiber diameter was 70 (m, and the restoration angle after ten minutes from bending it at 90 degrees was 5 degrees. Fifty of the thus-obtained filaments were tied, and cut at a length of 30 cm and evenly gathered to make three delicate pieces, which was then employed as the fiber for artificial hair. The end portion was tied by the same filament as that of those three pieces by winding up, and the root portion was fixed to the hair by using hair pins, to be used as an extension (attached hair). As this attached hair had such good shape-retaining property, the shape of the three pieces was not untied or impaired even being worn all day. Since it was possible to make the artificial hair in various colors by changing the pigments or dyes, the color of the attached hair could be changed according to one's taste.

Example 3

Preparation of a Plastically Deformable Filament Containing a Thermoplastic Resin To 100 weight parts of high density polyethylene containing 1.2 weight % of propylene as a comonomer (the content of comonomer was measured by means of NMR; MFR measured according to ASTM D1238 was 0.35 g/10 min, Mw/Mn calculated from the weight average molecular weight (Mw) and the number average molecular weight (Mn) measured by the gel permeation chromatography (GPC) was 12; a density measured according to ASTM D1505 was 0.958 g/cm$^3$, and a melting point was 135° C.), added was a master batch for coloring in a proportion of 3 weight parts, to obtain a mixture. The master batch had been obtained by kneading 5 weight parts of anthraquinone type yellow and 10 weight parts of disazo type yellow with 100 weight parts of medium density polyethylene (manufactured by Mitsui Chemicals, Inc., density 0.943 g/cm$^3$), and pelletizing the mixture by using an extrusion molder. The mixture containing the master batch was melt spun under the following conditions, elongated with the elongation ratio of 8 folds in the longitudinal direction, and annealed.

Extrusion rate: 2.3 kg/hr

Extruder: 30 mmϕ (L/D=28, compression ratio 2.3)

Die opening: nozzle diameter 1.4 mmϕ, 20 holes

Molding temperature (cylinder and die): 290° C.

Cooling tank: 1400 mm, temperature 55° C.

Drawing speed during melt spinning: 4 m/min

Elongation tank: 95° C. water tank (length 1700 mm)

Annealing tank: a hot air oven, temperature 110° C., length 2000 mm

Winding speed during the elongation: 32 m/min

While measuring the diameter of the resultant filament (maximum thickness) by the use of a slide calipers, the restoration angle θ after allowing it to stand for 10 minutes after bending at 90 degrees was measured, as shown in FIG. 1. The fiber diameter was 70 μm (33 denier), and the restoration angle after ten minutes from bending it at 90 degrees was 23 degrees. The thus-obtained filaments were cut at a length of 350 mm, and wound ten times around a cylindrical collar having a diameter of 10 mm. After keeping them at room temperature for ten minutes, the cylindrical collar was removed, and the number of remaining windings was measured after additional 5 minutes at room temperature. The winding width around the collar was not more than 10 mm, and the filaments were not intersected each other. The number of remaining windings was measured for 5 samples, and the results were 4, 4, 4, 4.25 and 3.75 times respectively, and the shape retention calculated on the basis of these results was 40%.

The thus-obtained filaments colored yellow were cut at a length of 30 cm in order to use for artificial hair of a western-style doll. A plurality of filaments were tied, and the tied portion was fixed on the crown of head of the doll to make its hair. The 20 cm portion at the end of the hair was slightly wound up on an article having a roll shape to make a waved shape as desired. The feature of waved hair could maintain its shape as it was, and the hair style was not impaired when the doll was stood decoratively. Afterwards, when the hair was frizzled in order to obtain more delicate wave, the hair was easily transformed by hands and maintained the shape as it was.

Example 4

A filament was obtained in the same manner as in Example 3, except that a mixture of phthalocyanine blue with medium density polyethylene (manufactured by Mitsui Chemicals, Inc., density 0.943 g/cm$^3$) was used as a master batch, instead of the mixture used in Example 3, with 8.2 kg/hr of extrusion rate of the resin, 36.8 m/min of winding speed during the elongation and 9.2 folds of the elongation ratio. While measuring the diameter of the resultant filament (maximum thickness) by the use of a slide calipers, the restoration angle θ after allowing it to stand for 10 minutes after bending at 90 degrees was measured, as shown in FIG. 1. The fiber diameter was 120 μm (100 denier), and the restoration angle after ten minutes from bending it at 90 degrees was 12 degrees. The shape retention of the resultant filament was obtained in the same manner as in Example 3. The number of remaining windings was measured for 5 samples, and the results were 4.5, 4.5, 5, 5 and 5 times respectively, and the shape retention calculated on the basis of these results was 48%.

Fifty of the thus-obtained filaments were tied, and cut at a length of 30 cm to make three delicate pieces, which was then employed as the fiber for artificial hair. The end portion was tied by the same filament as that of those three pieces by winding up, and the root portion was fixed to the hair by using hair pins, to be used as an extension (attached hair). As this attached hair had such good shape-retaining property, the shape of three pieces was not untied or impaired even being worn all day.

Example 5~9

In Examples 5 to 9, filaments were prepared according to the following procedures.

Example 5

A mixture was obtained in the same manner as in Example 3, was melt spun under the following conditions, and elongated with the elongation ratio of 9.5 folds in the longitudinal direction.

Extrusion rate: 8.4 kg/hr
Extruder: 30 mmϕ (L/D=28, compression ratio 2.3)
Die opening: nozzle diameter 1.4 mmϕ, 10 holes
Molding temperature (cylinder and die): 290° C.
Cooling tank: length 1400 mm, temperature 55° C.
Drawing speed during melt spinning: 4 m/min
Elongation tank: 95° C. water tank (length 1700 mm)
Annealing tank: a hot air oven at 115° C. (length 2000 mm)
Winding speed during the elongation: 38 m/min While measuring the diameter of the resultant filament (maximum thickness) by the use of a slide calipers, the restoration angle θ after allowing it to stand for 10 minutes after bending at 90 degrees was measured as shown in FIG. 1, and the shape retention was obtained. The fiber diameter was 170 μm (200 denier), and the restoration angle after ten minutes from bending it at 90 degrees was 3 degrees. Furthermore, for the thus-obtained filaments, the shape retention was obtained in the same manner as in Example 3. The number of remaining windings was measured for 5 samples, and the results were 5.75, 5.75, 6, 6 and 6.5 times respectively, and the shape retention calculated on the basis of these results was 60%.

Example 6

A filament of a thermoplastic resin was obtained in the same manner as in Example 5, except that the extrusion rate of the resin was 12.7 kg/hr. While measuring the diameter of the resultant filament (maximum thickness) by the use of a slide calipers, the restoration angle θ after allowing it to stand for 10 minutes after bending at 90 degrees was measured as shown in FIG. 1, and the shape retention was obtained. The fiber diameter was 210 μm (300 denier), and the restoration angle after ten minutes from bending it at 90 degrees was 3 degrees. Furthermore, for the thus-obtained filaments, the shape retention was obtained in the same manner as in Example 3. The number of remaining windings was measured for 5 samples, and the results were 6.5, 6.5, 6.75, 6.75 and 7 times respectively, and the shape retention calculated on the basis of these results was 67%.

Example 7

A mixture was obtained in the same manner as in Example 3, was melt spun under the following conditions, and elongated with the elongation ratio of 10.5 folds in the longitudinal direction.

Extrusion rate: 11.7 kg/hr
Extruder: 30 mmϕ (L/D=28, compression ratio 2.3)
Die opening: nozzle diameter 1.4 mmϕ, 10 holes
Molding temperature (cylinder and die): 290° C.
Cooling tank: length 1400 mm, temperature 55° C.
Drawing speed during melt spinning: 2 m/min
Elongation tank: 95° C. water tank (length 1700 mm)
Annealing tank: a hot air oven at 120° C. (length 2000 mm)
Winding speed during the elongation: 21 m/min While measuring the diameter of the resultant filament (maximum thickness) by the use of a slide calipers, the restoration angle θ after allowing it to stand for 10 minutes after bending at 90 degrees was measured as shown in FIG. 1, and the shape retention was obtained. The fiber diameter was 270 μm (500 denier), and the restoration angle after ten minutes from bending it at 90 degrees was 3 degrees. Furthermore, for the thus-obtained filaments, the shape retention was obtained in the same manner as in Example 3. The number of remaining windings was measured for 5 samples, and the results were 7.25, 7.5, 7.7, 7.7 and 8 times respectively, and the shape retention calculated on the basis of these results was 76%.

Example 8

To 100 weight parts of high density polyethylene containing 0.35 weight % of propylene as a comonomer (the content of comonomer was measured by means of NMR; MFR measured according to ASTM D1238 was 0.30 g/10 min; Mw/Mn calculated from the weight average molecular weight (Mw) and the number average molecular weight (Mn) measured by the gel permeation chromatography (GPC) was 5.1; a density measured according to ASTM D1505 was 0.956 g/cm$^3$; and a melting point was 135° C.), added was a master batch for coloring in a proportion of 3 weight parts, to obtain a mixture. The master batch had been obtained by kneading 6 weight parts of disazo yellow and trace amount of UV luminant with 100 weight parts of high density polyethylene (manufactured by Mitsui Chemicals, Inc., density 0.960 g/cm$^3$), and pelletizing the mixture by using an extrusion molder. The mixture containing the master batch was melt spun and elongated under the same conditions as described in Example 3, to obtain a filament.

While measuring the diameter of the resultant filament (maximum thickness) by the use of a slide calipers, the restoration angle θ after allowing it to stand for 10 minutes after bending at 90 degrees was measured as shown in FIG. 1, and the shape retention was obtained. The fiber diameter was 70 μm (33 denier), and the restoration angle after ten minutes from bending it at 90 degrees was 18 degrees. Furthermore, for the thus obtained filaments, the shape retention was obtained in the same manner as in Example 3. The number of remaining windings was measured for 5 samples, and the results were 4, 4, 4.25, 4.3 and 4.3 times respectively, and the shape retention calculated on the basis of these results was 42%.

Example 9

A mixture was obtained in the same manner as in Example 8, was melt spun under the following conditions, and elongated with the elongation ratio of 10.5 folds in the longitudinal direction.

Extrusion rate: 11.7 kg/hr
Extruder: 30 mmϕ (L/D=28, compression ratio 2.3)
Die opening: nozzle diameter 1.4 mmϕ, 10 holes
Molding temperature (cylinder and die): 290° C.
Cooling tank: length 1400 mm, temperature 55° C.
Drawing speed during melt spinning: 2 m/min
Elongation tank: 95° C. water tank (length 1700 mm)
Annealing tank: a hot air oven at 115° C. (length 2000 mm)
Winding speed during the elongation: 21 m/min While measuring the diameter of the resultant filament (maximum thickness) by the use of a slide calipers, the restoration angle θ after allowing it to stand for 10 minutes after bending at 90 degrees was measured as shown in FIG. 1, and the shape retention was obtained. The fiber diameter was 270 μm (500 denier), and the restoration angle after ten minutes from bending it at 90 degrees was 2 degrees. Furthermore, for the thus-obtained filaments, the shape retention was obtained in the same manner as in Example 3. The number of remaining windings was measured for 5 samples, and the results were 7.5, 7.75, 7.75, 8 and 8 times respectively, and the shape retention calculated on the basis of these results was 78%.

The filaments obtained from Examples 5 to 9 were cut at a length of 30 cm in order to use for artificial hair of a western-style doll. A plurality of filaments were tied, and the tied portion was fixed on the crown of head of the doll to make its hair. The 20 cm portion at the end of the hair was slightly wound up on an article having a roll shape to make a waved shape as desired. The feature of waved hair could maintain its shape as it was, and the hair style was not impaired when the doll was stood decoratively. Afterwards, when the hair was frizzled in order to obtain more delicate wave, the hair was easily transformed by hands and maintained the shape as it was.

INDUSTRIAL APPLICABILITY

The fiber for artificial hair according to the present invention may be colored with a colorant such as pigments or dyes as desired, whereby it can be employed without unnaturalness as an aid or an alternative of human hair, or used for dandyism. The fiber can be repeatedly used by setting the shape in order by hands or by transforming it into other shapes, so that it can be handled with ease and the shape can be maintained as it is. Accordingly, the fiber may be employed for periwigs, wigs, doll hair, hair accessories, eyelashes, beards, or the like by virtue of its characteristic properties.

What is claimed is:

1. A fiber for artificial hair comprising a plastically deformable filament (A) comprising a high density polyethylene having a density in the range of not less than 0.945 g/cm$^3$ and not more than 0.970 g/cm$^3$ which has a restoration angle of not more than 30 degrees after 10 minutes from bending the filament at 90 degrees.

2. A fiber for artificial hair comprising a plastically deformable filament (A) comprising a high density polyethylene having a density in the range of not less than 0.945 g/cm$^3$ and not more than 0.970 g/cm$^3$ with a shape retention of not less than 30% when the filament is wound ten times on a cylindrical collar having a diameter of 10 mm and allowed to stand for 10 minutes, and the filament is removed from the cylindrical collar and allowed to stand for 5 minutes.

3. The fiber for artificial hair according to claim 1, wherein a fiber diameter of the plastically deformable filament (A) comprising the thermoplastic resin is from 30 to 500 μm.

4. The fiber for artificial hair according to claim 3, wherein the plastically deformable filament (A) comprising the thermoplastic resin is colored.

5. Periwigs, wigs, doll hair, hair accessories, eyelashes or beards using the fiber for artificial hair as described in claim 1.

6. The fiber for artificial hair according to claim 2, wherein a fiber diameter of the filament (A) comprising the thermoplastic resin is from 30 to 500 μm.

7. The fiber for artificial hair according to claim 6, wherein the filament (A) comprising the thermoplastic resin is colored.

8. Periwigs, wigs, doll hair, hair accessories, eyelashes or beards using the fiber for artificial hair as described in claim 2.

9. Periwigs, wigs, doll hair, hair accessories, eyelashes or beards using the fiber for artificial hair as described in claim 3.

10. The fiber for artificial hair according to claim 1, wherein the high density polyethylene contains α-olefin having 3 to 6 carbon atoms of less than 2 weight %.

11. The fiber for artificial hair according to claim 1, wherein the high density polyethylene contains α-olefin having 3 to 6 carbon atoms of less than 2 weight %.

* * * * *